US006875022B2

(12) United States Patent
Ma

(10) Patent No.: US 6,875,022 B2
(45) Date of Patent: Apr. 5, 2005

(54) ELECTRICAL CONNECTOR ASSEMBLY WITH ROTATABLY ASSEMBLED PICK UP CAP

(75) Inventor: Hao-Yun Ma, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 18 days.

(21) Appl. No.: 10/613,585

(22) Filed: Jul. 2, 2003

(65) Prior Publication Data

US 2004/0166710 A1 Aug. 26, 2004

(30) Foreign Application Priority Data

Feb. 26, 2003 (CN) ..... 92200294 U

(51) Int. Cl.[7] ..... H01R 13/60
(52) U.S. Cl. ..... 439/41; 439/940
(58) Field of Search ..... 439/41, 940, 125, 439/149, 138

(56) References Cited

U.S. PATENT DOCUMENTS 4,560,216 A * 12/1985 Egawa ..... 439/41
5,690,505 A * 11/1997 Hirata ..... 439/41
5,819,404 A 10/1998 Whiting
6,413,111 B1 7/2002 Pickles et al.
6,478,558 B2 11/2002 Yamanaka et al.
6,533,592 B1 3/2003 Chen et al.
6,547,609 B2 4/2003 Howell et al.
6,561,825 B1 5/2003 McHugh et al.
6,572,383 B1 6/2003 Yu
2001/0041468 A1 * 11/2001 Zweigle et al. ..... 439/135

* cited by examiner

*Primary Examiner*—Tho D. Ta
(74) *Attorney, Agent, or Firm*—Wei Te Chung

(57) ABSTRACT

An electrical connector assembly includes an electrical connector (2) and a pick up cap (1) rotatably attached onto the connector to provide a flat top surface. The connector defines two spaced chambers (2200) in a middle portion of an end thereof, and forms an engaging wall (211) in a middle of an opposite end thereof. The pick up cap includes a smooth top surface (111), two spaced mounting portions (1111) at an end thereof, and two spaced latch arms (1102) at an opposite end thereof. In assembly, the mounting portions of the pick up cap are firstly insert into the corresponding chambers of the housing. The pick up cap is then rotated downwardly about an axis defined above the chambers. The latch arms deflect outwardly and finally resiliently abut against the engaging wall of the housing. Thus, the pick up cap is securely fastened on the connector.

8 Claims, 7 Drawing Sheets

ELECTRICAL CONNECTOR ASSEMBLY WITH ROTATABLY ASSEMBLED PICK UP CAP

BACKGROUND OF THE INVENTION

1. Field of the Invention

The present invention relates to an electrical connector assembly, and particularly to a combined pick up cap and electrical connector in which the pick up cap is rotatably attached onto the electrical connector.

2. Description of the Related Art

On many production lines, electronic components such as electrical connectors are accurately positioned on a printed circuit board (PCB) such as a motherboard by means of a vacuum suction device. Since an electrical connector typically has a multiplicity of through holes in a top portion thereof, a pick up cap has to be pre-attached on the electrical connector. The vacuum suction device is then able to engage on a flat top surface of the pick up cap, in order to reliably move and accurately position the electrical connector onto the PCB. This kind of pick up cap is disclosed in U.S. Pat. No. 6,413,111.

Referring to FIGS. 6 and 7, a prior electrical connector assembly derived from the assignee's earlier design, comprises an electrical connector 8 and a pick up cap 9 vertically mounted to the socket 8 to provide a flat top surface for the connector assembly. The connector 8 has an insulative housing 80, and a plurality of electrical contacts 81 received in the housing 80. The housing 80 is generally rectangular, and defines a rectangular cavity 801 in a middle portion thereof. The housing has a pair of engaging walls 800 respectively formed on middle portions of two opposite ends thereof. A chamfer 8000 is formed at an upper end of each engaging wall 800. A multiplicity of passageways 803 is defined in a portion of the housing 80 under the cavity 801, the passageways 803 receiving a corresponding number of the contacts 81 therein. The pick up cap 9 comprises a planar body 91, and a pair of latch arms 92 at each of two opposite ends of the planar body 91. The planar body 91 has a smooth top surface 911, and a bottom surface 910 opposite to the top surface 911. The latch arms 92 extend perpendicularly from the bottom surface 910 of the planar body 91. Each pair of latch arms 92 is symmetrically opposite from the other pair of latch arms 92, with the respective pairs of latch arms 92 bending obliquely toward each other.

In assembly, the pick up cap 9 is disposed directly over a top of the housing 80, with the latch arms 92 loosely contacting the chamfers 8000 of the corresponding engaging walls 800. Then, the pick up cap 9 is pressed downwardly. The latch arms 92 are deflected outwardly as they ride over the chamfers 8000. The bottom surface 910 of the pick up cap 9 is attached on the top of the housing 80, and the latch arms 92 resiliently abut against the engaging walls 800. Thus, the pick up cap 9 is securely fixed on the housing 80. The connector 8 is moved to and positioned on a PCB (not shown) by using a vacuum suction device (not shown) to suck the top surface 911 of the pick up cap 9.

In above-mentioned assembly operation, if the latch arms 92 dose not simultaneously contact the chamfers 8000 of the corresponding engaging walls 800, the latch arms 92 are unlikely to engage with the engaging walls 800. When the pick up cap 9 are pressed downwardly, the latch arms which contact a top surface of the housing 80 is liable to be broken. Thus, the latch arms 92 must simultaneously ride over the chamfers 8000 of the corresponding engaging walls 800 accurately, which increases difficulty of attaching the pick up cap 9 onto the connector 8.

In view of the above, a new electrical connector assembly with a pick up cap which overcomes the above-mentioned disadvantages is desired.

SUMMARY OF THE INVENTION

Accordingly, an object of the present invention is to provide an electrical connector assembly having a pick up cap that can be readily attached onto an electrical connector of the electrical connector assembly.

To achieve the above-mentioned object, an electrical connector assembly in accordance with a preferred embodiment of the present invention comprises an electrical connector and a pick up cap rotatably attached onto the connector to provide a flat top surface for being sucked by a vacuum suction device. The connector comprises a generally rectangular housing and a plurality of electrical contacts received in the housing. The housing defines a pair of spaced chambers in a middle portion of an end thereof, and forms an engaging wall in a middle of an opposite end thereof. The pick up cap comprises a smooth top surface, a pair of spaced mounting portions at an end thereof, and a pair of spaced latch arms at an opposite end thereof. In assembly, the mounting portions of the pick up cap are firstly insert into the corresponding chambers of the housing. The pick up cap is then rotated downwardly about an axis defined above the chambers. The latch arms deflect outwardly and finally resiliently abut against the engaging wall of the housing. Thus, the pick up cap is securely fastened on the connector.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
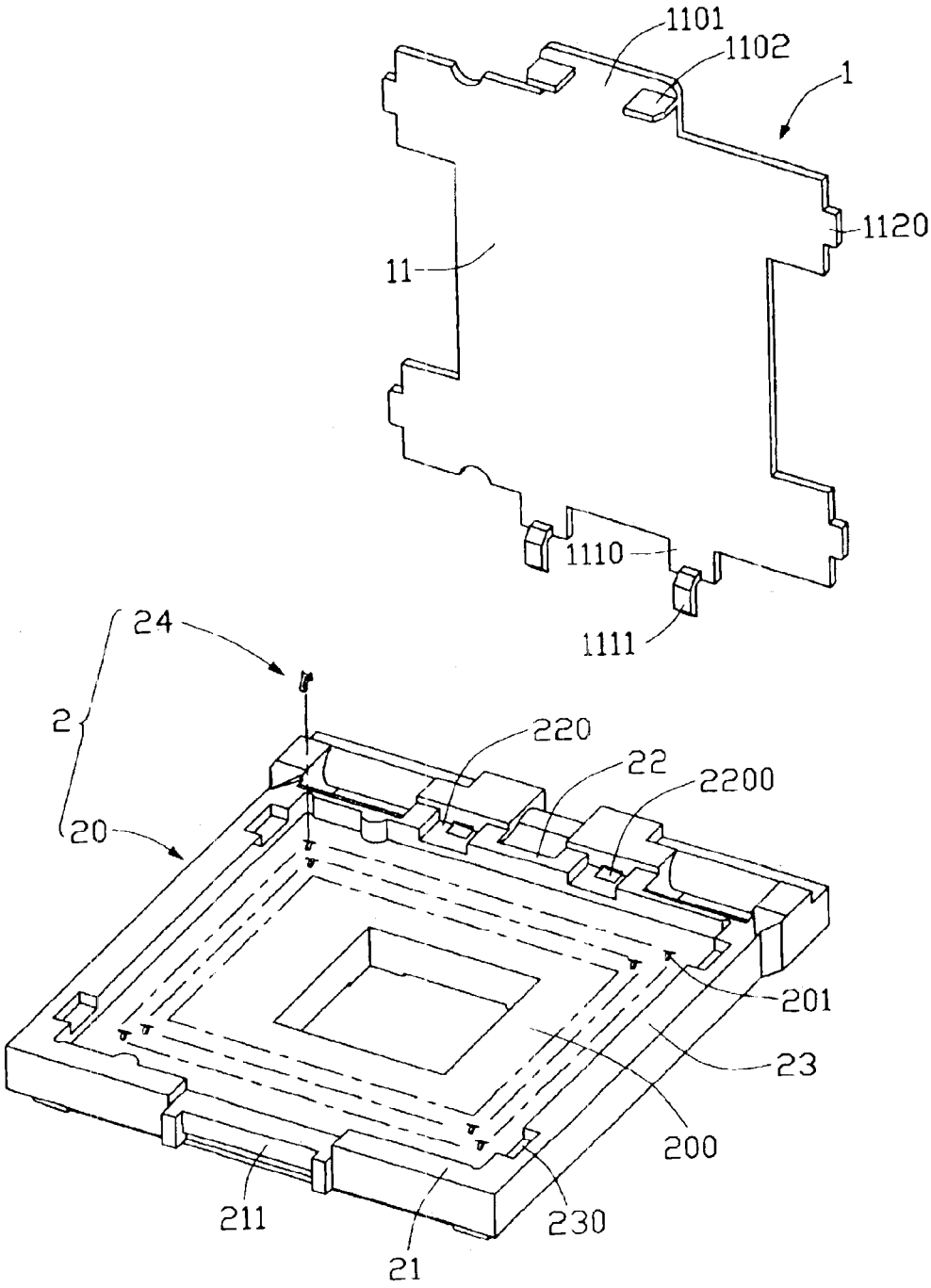
FIG. 1 is a simplified, exploded isometric view of an electrical connector assembly of the present invention, the connector assembly comprising an electrical connector and a pick up cap.
Figure 2:
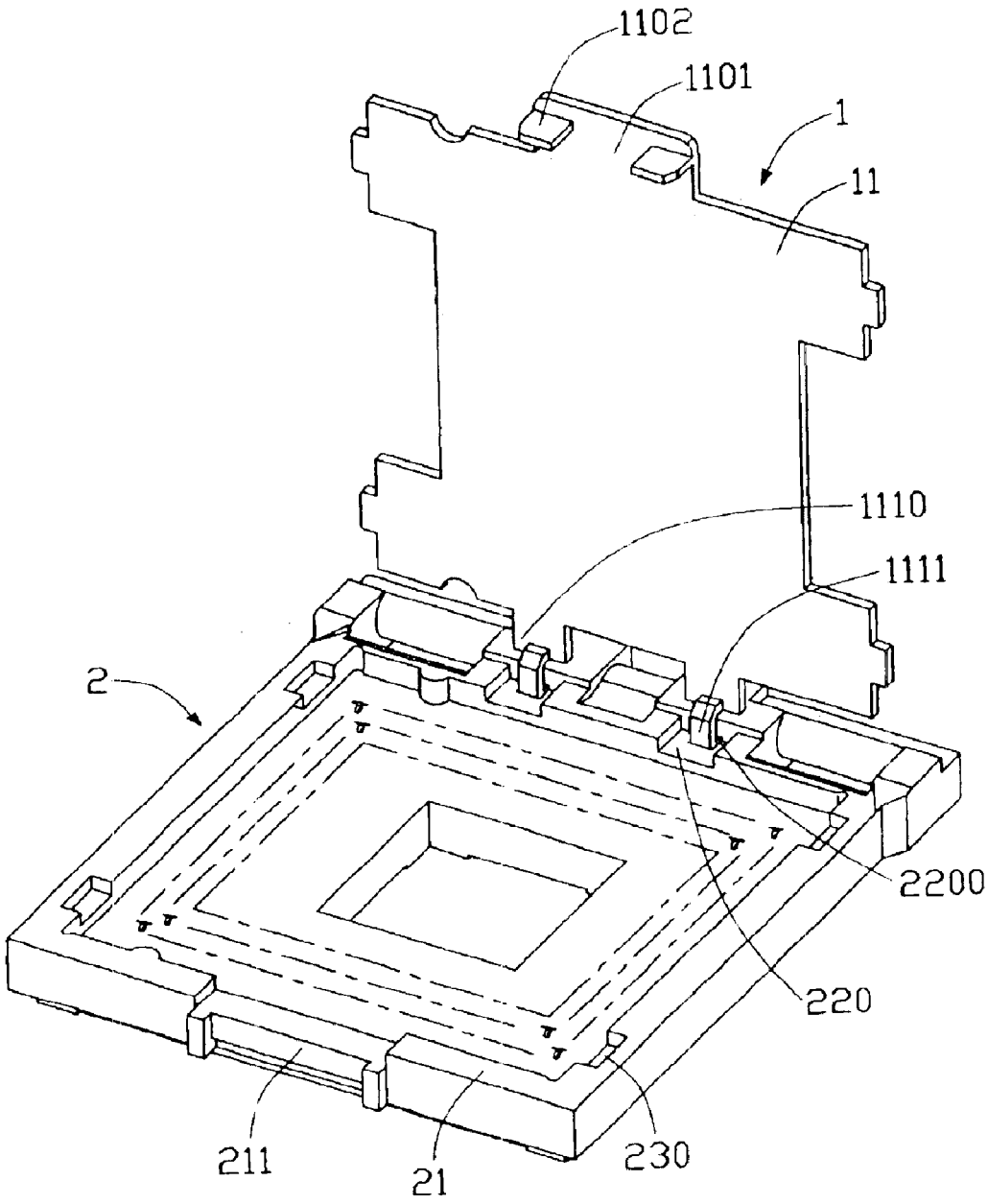
FIG. 2 is an assembled view of FIG. 1, showing the pick up cap in a vertical position pivotably engaged with the connector.

Referring to FIG. 1, an electrical connector assembly of the present invention comprises an electrical connector 2 and a pick up cap 1. The pick up cap 1 is rotatably attached onto the connector 2 to provide a flat top surface for the connector assembly.

The connector 2 comprises a generally rectangular insulative housing 20, and a plurality of electrical contacts 24 received in the housing 20. The housing 20 comprises a front side 21, a rear side 22 opposite to the front side 21, and a pair of opposite lateral sides 23 interconnecting the front side 21 and the rear side 22. A rectangular cavity 200 is defined in a middle portion of the housing 20, for receiving a central processing unit (CPU) (not shown) therein. A portion of the housing 20 under the cavity 200 defines a multiplicity of passageways 201, the passageways 201 receiving the contacts 24 therein. A securing portion having an engaging wall 211 is formed in a middle portion of the front side 21 of the housing 20. A pair of spaced recesses 220 is defined in a middle portion of the rear side 22 of the housing 20. A pair of chambers 2200 is defined in the rear side 22, below and in communication with the recesses 220 respectively. A pair of spaced, rectangular steps 230 is formed in each lateral side 23 of the housing 20, adjacent the cavity 200.

Figure 3:
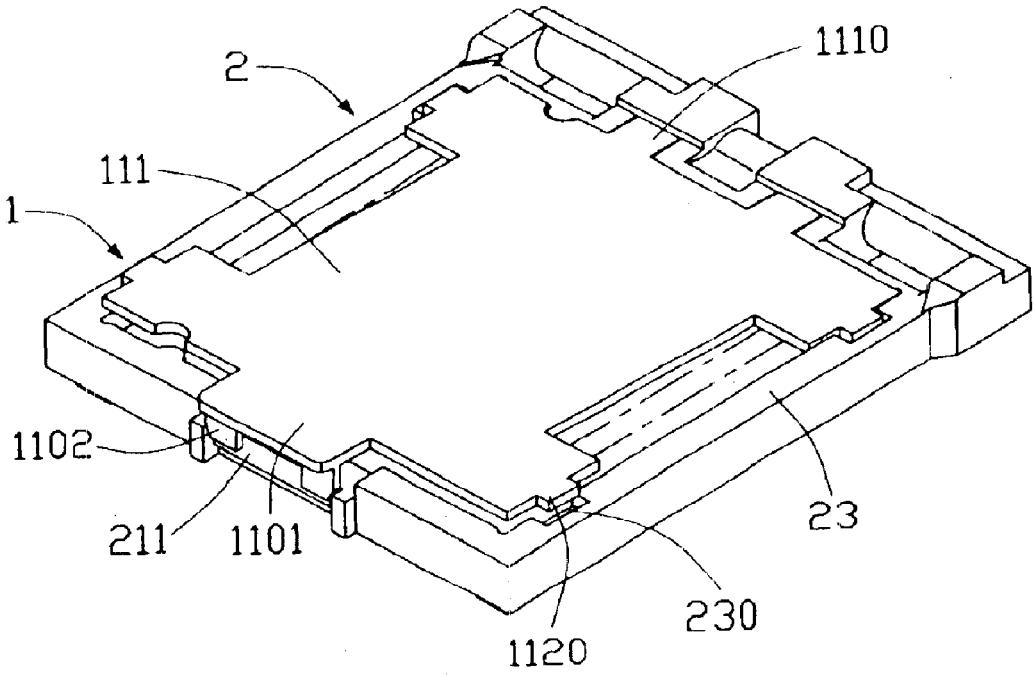
FIG. 3 is similar to FIG. 2, but showing the pick up cap rotated down to a position where it begins to engage with the connector.
Figure 4:
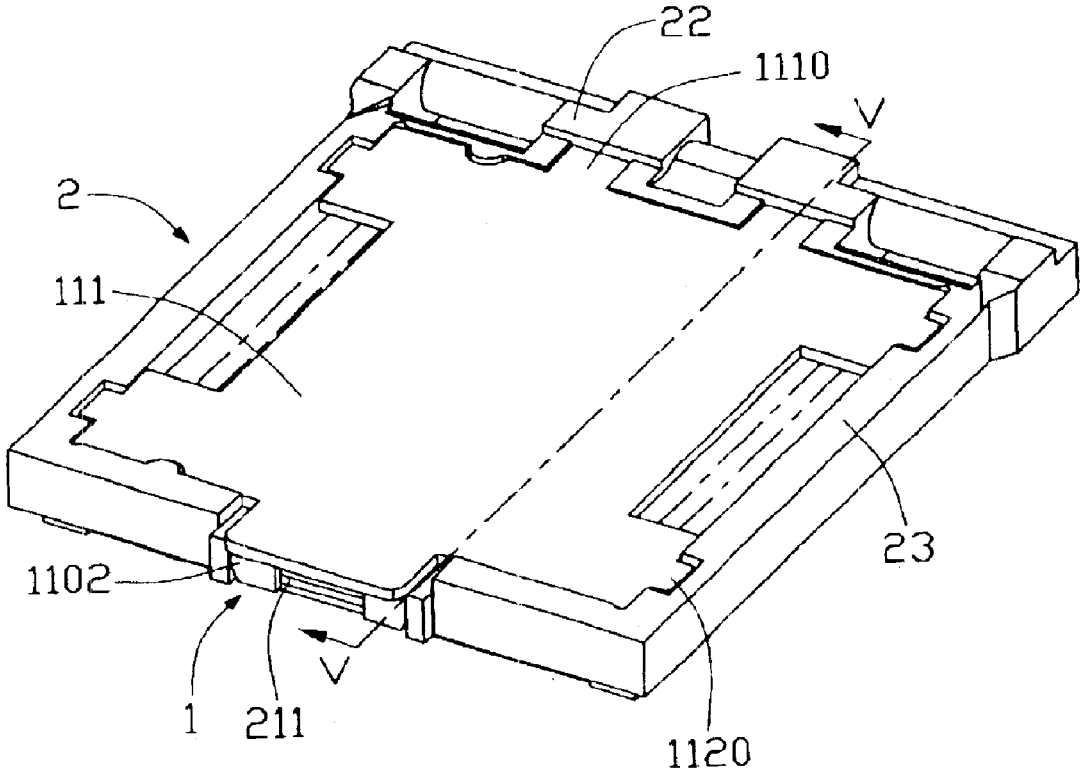
FIG. 4 is similar to FIG. 3, but showing the pick up cap rotated further down and engaged with the connector.
Figure 5:
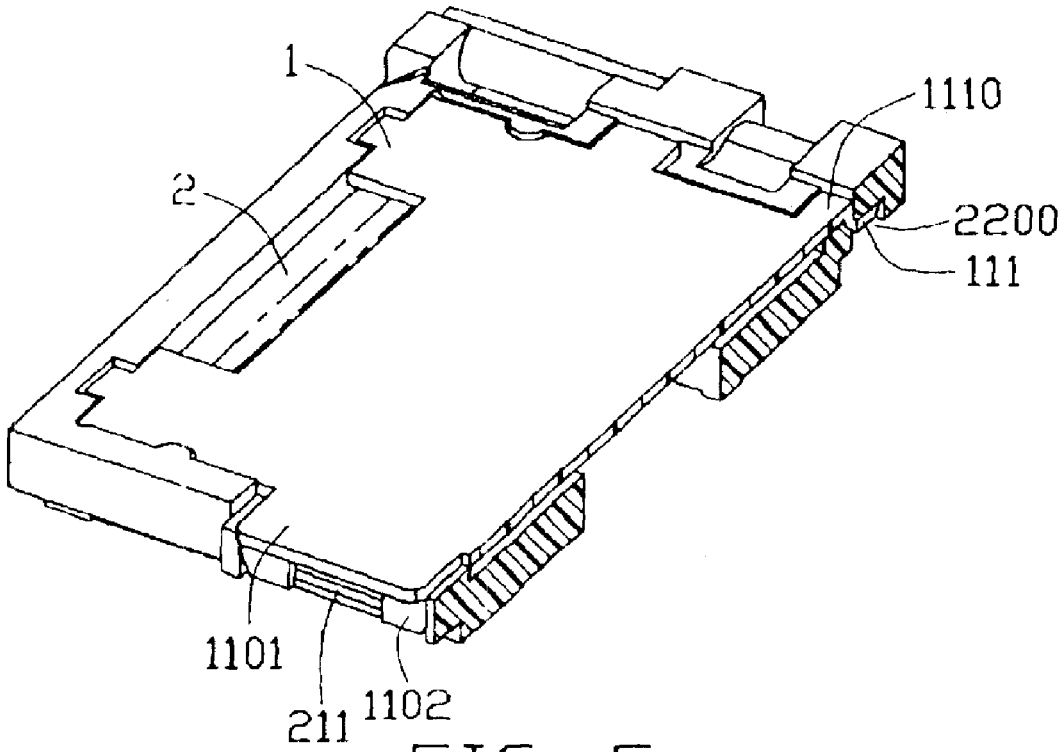
FIG. 5 is a cut-away view taken along line V—V of FIG. 4.
Figure 6:
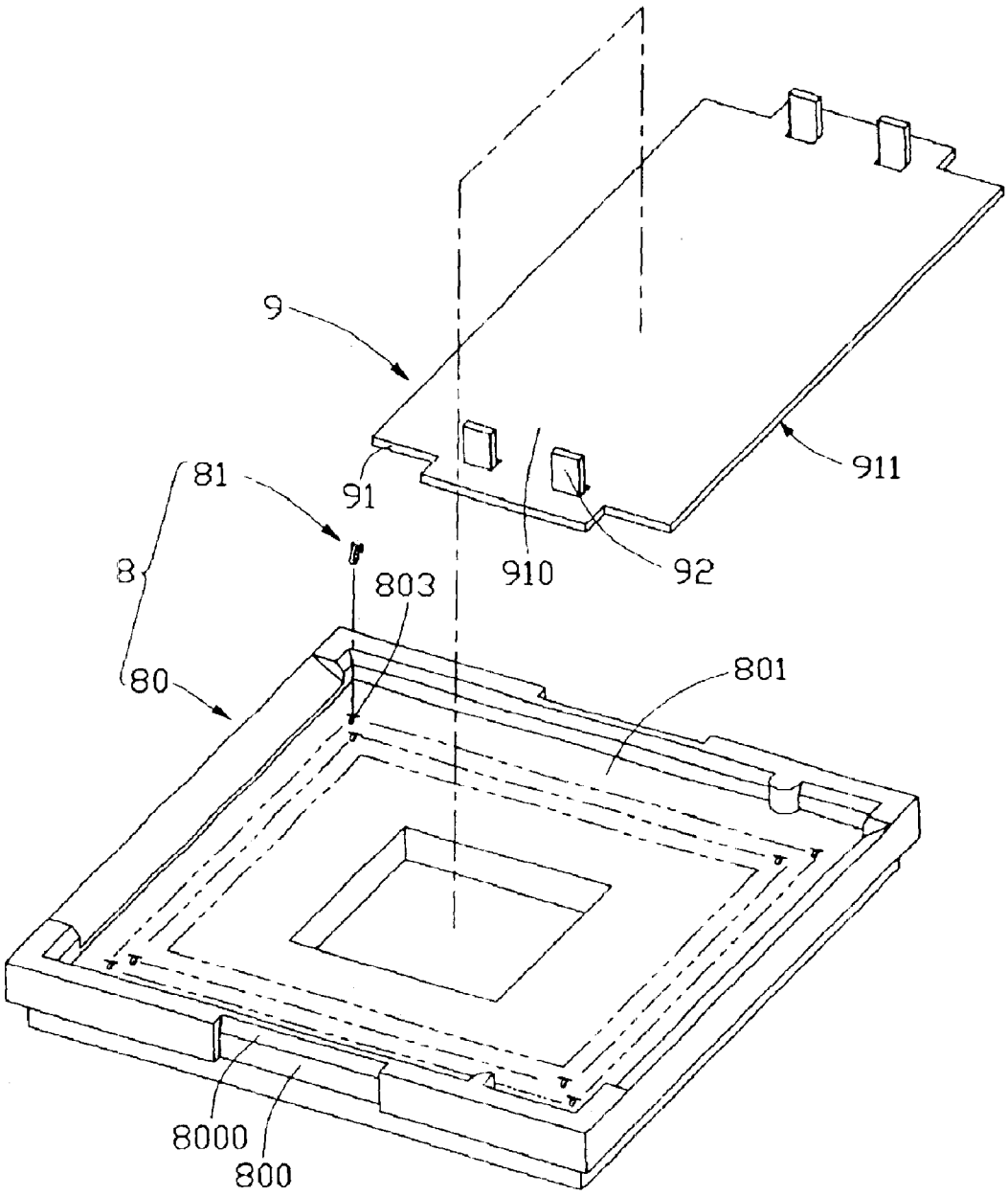
FIG. 6 (PRIOR ART)
FIG. 6 is a simplified, exploded isometric view of a conventional electrical connector assembly, but showing a pick up cap of the electrical connector assembly inverted.
Figure 7:
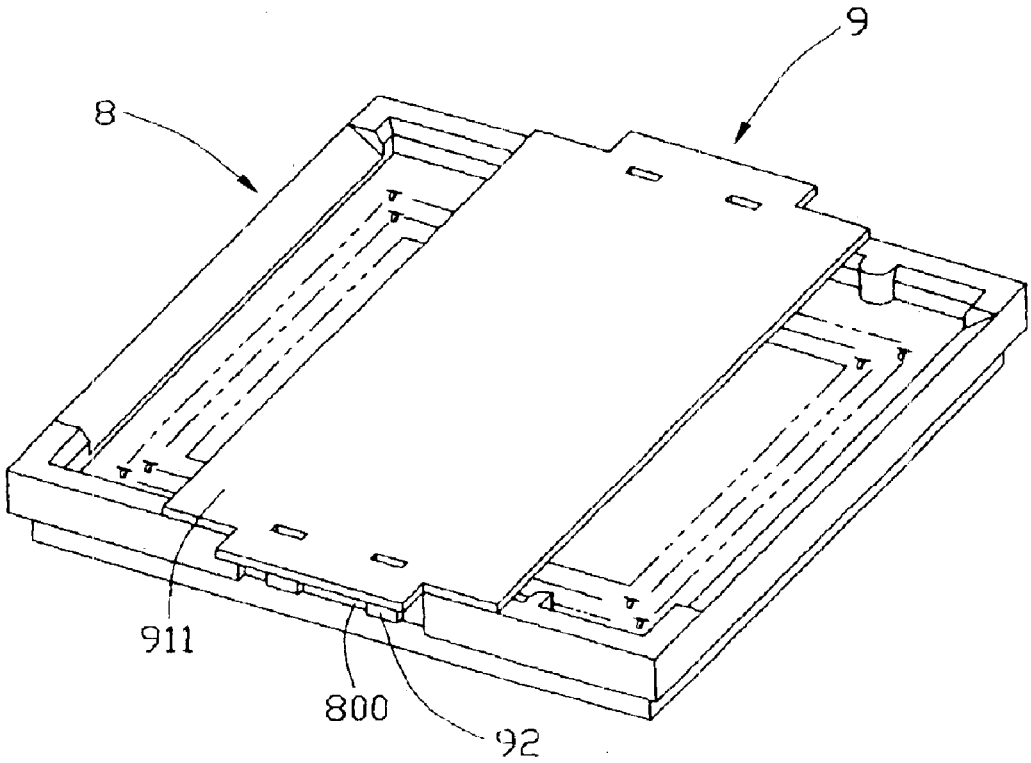
FIG. 7 (PRIOR ART)
FIG. 7 is an assembled view of FIG. 6.

The pick up cap 1 has a planar body 11 having a smooth top surface 111 (see FIG. 3). The planar body 11 comprises a lip 1101 at a middle of a front end thereof, a pair of spaced tails 1110 at a middle portion of an opposite rear end thereof corresponding to the recesses 220 of the housing 20, and a pair of spaced tabs 1120 at each of opposite lateral sides thereof corresponding to respective steps 230 of the housing 20. A pair of spaced, parallel latch arms 1102 depends from a bottom of the lip 1101, corresponding to the engaging wall 211 of the housing 20. A pair of mounting portions 1111 extends arcuately from bottoms of the tails 1110 respectively, for engaging in the chambers 2200 of the housing 20.

Also referring to FIGS. 2 through 5, in assembly, the mounting portions 1111 of the pick up cap 1 are inserted into the corresponding chambers 2200 of the housing 20 at an initial installation position. Then, the pick up cap 1 is rotated downwardly about an axis defined above the chambers 2200 of the rear side 22 of the housing 20. When an inner surface of each of the latch arms 1102 loosely contacts a top edge of the engaging wall 211 of the housing 20, the latch arms 1102 begin to engage therewith. The pick up cap 1 is continued to be rotated downwardly, and the latch arms 1102 deflect outwardly as they ride over the engaging walls 211. The bottom of the lip 1101 is attached on a top of the securing portion, with the tabs 1120 fittingly attached on the corresponding steps 230, and the tails 1110 fittingly attached in the corresponding recesses 220. The latch arms 1102 resiliently abut against the engaging wall 211 of the securing portion. Thus, the pick up cap 1 is securely fastened on the connector 2. In this position, a vacuum suction device can suck the top surface 111 of the pick up cap 1 in order to move the connector assembly to a desired location.

As can be seen from FIG. 3, the pick up cap 1 has only one pair of latch arms 1102. In above-mentioned assembly operation, the pick up cap 1 is prepositioned via the mounting portions 1111 of pick up cap 1 engaging in the corresponding chambers 2200 of the housing 20. Thus, when the pick up cap 1 is rotated down, the latch arms 1102 reliably ride over the engaging wall 211 of the housing 20. Therefore, the pick up cap 1 is readily assembled onto the connector 2. It is noted that the connector 2 may be further equipped with the clip device for some LGA types use.

While a preferred embodiment in accordance with the present invention has been shown and described, equivalent modifications and changes known to persons skilled in the art according to the spirit of the present invention are considered within the scope of the present invention as defined in the appended claims. For example, the connectors other than for the CPU usage may incorporate the subject invention to equip the housing with the pick up cap under a non-linear or non-vertical assembling way, e.g., sliding, translation, curvature or rotation, etc.

What is claimed is:

1. An electrical connector assembly comprising:

an electrical connector comprising a plurality of electrical contacts and an insulative housing receiving the contacts therein, the housing defining at least one chamber in a middle portion of an end thereof and has a securing portion at an opposite end thereof;

a pick up cap defining a planar body with a sufficiently large upward top face thereof for suction, said planar body parallel to a top of the housing, at least one mounting portion at an end of the planar body, and at least one latch arm at an opposite end pf the planar body, the at least one mounting portion pivotably engaging in the at least one chamber, and the at least one latch arm resiliently engaging with the securing portion;

wherein a lip is formed in a middle of the end of the planar body, and a pair of spaced latch arms extends downwardly inwardly from a bottom of the lip;

wherein the securing portion has an engaging wall for engaging with the latch arms of the pick up cap;

wherein a pair of steps is formed at each of two opposite lateral sides of the housing;

wherein a pair of tabs is formed at each of two opposite lateral sides of the planar body, each tab being attached on one of the steps of the housing.

2. The electrical connector assembly as claimed in claim 1, wherein a pair of spaced tails is formed at the end of the planar body, and a pair of mounting portions extends arcuately from a bottom of the corresponding tails.

3. The electrical connector assembly as claimed in claim 2, wherein a pair of spaced recesses is defined in portions of the housing above the chambers, the recesses in communication with the chambers and receiving the tails of the pick up cap.

4. An electrical connector assembly comprising:

an electrical connector including an insulative housing with a plurality of contacts therein; and a pick up cap defining a planar body with a sufficiently large upward top face thereof for suction, said pick up cap including an end section pivotally assembled to one portion of the housing, and another portion opposite to said end section fixedly attaching to the housing for holding said pick up cap in a horizontal position relative to the housing;

wherein said end section is detachable from said portion of the housing so as to allow complete removal of the pick up cap from the housing.

5. The electrical connector assembly as claimed in claim 4, wherein said end section is allowed to be released from the housing when said pick up cap is upwardly moved from said horizontal position to a non-horizontal position.

6. The electrical connector assembly as claimed in claim 4, wherein said pick up cap covers a gravity center of the connector.

7. An electrical connector assembly comprising:

an electrical connector including an insulative housing with a plurality of contacts therein, said housing defining a mounting section thereof, and a pick up cap defining a planar body with a sufficiently large upward top face thereof for suction, said pick up cap including a mounting leg mounted to said mounting section, and another portion spaced from said mounting leg fixedly attaching to the housing for holding said pick up cap in a final horizontal position relative to the housing, wherein said mounting section and said mounting leg are configured to have the mounting leg assembled to the mounting section in an either non-linear or non-vertical way during mounting said pick up cap to housing from an initial installation position to said final horizontal position; wherein said mounting leg is detachable from said mounting section of the housing so as to allow complete removal of the pick up cap from the housing.

8. The assembly as claimed in claim 7, wherein said mounting leg is rotatably assembled to the mounting section.

* * * * *